United States Patent [19]

Wan

[11] Patent Number: 4,875,933

[45] Date of Patent: Oct. 24, 1989

[54] MELTING METHOD FOR PRODUCING LOW CHROMIUM CORROSION RESISTANT AND HIGH DAMPING CAPACITY FE-MN-AL-C BASED ALLOYS

[75] Inventor: Chi-Meen Wan, New Canaan

[73] Assignee: Famcy Steel Corporation, Pittsburgh, Pa.

[21] Appl. No.: 218,695

[22] Filed: Jul. 8, 1988

[51] Int. Cl.[4] ..... C21D 1/74; C22C 38/04

[52] U.S. Cl. ..... 75/10.17; 75/10.66; 420/129; 420/72; 420/73; 420/74; 420/75; 420/76

[58] Field of Search ..... 420/72, 73, 74, 76, 420/77, 79, 129; 75/10.17, 10.66

[56] References Cited

U.S. PATENT DOCUMENTS 3,356,493 12/1967 Danis et al. ..... 420/72

FOREIGN PATENT DOCUMENTS 200543 12/1982 Japan ..... 420/74
348089 5/1978 U.S.S.R. ..... 420/72
1161577 6/1985 U.S.S.R. ..... 420/74

*Primary Examiner*—Deborah Yee

[57] ABSTRACT

This invention describes the melting of Fe-Mn-Al Alloys and includes production methods such as non-continuous casting, continuous casting, hot forging, hot rolling, cold rolling, surface finishing, and heat treating. Products produced using one or more of the above said methods include case ingot, billet, bloom, slab, cast piece, hot-rolled plate, hot-rolled coil, bar, rod, cold-rolled strip and sheet, and hot-forged piece. The said alloys consist principally of by weight 10 to 35 percent Mn, 4 to 12 percent Al, 0 to 12 percent Cr, 0.01 to 1.4 percent C, 0.3–1.5 Mo, 0.1–1% S, a small amount of Cu, Nb, V, CO, Ti, B, N, Zr, Hf, Ta, Sc, W, and Ni, and the balanced Fe.

12 Claims, No Drawings

MELTING METHOD FOR PRODUCING LOW CHROMIUM CORROSION RESISTANT AND HIGH DAMPING CAPACITY FE-MN-AL-C BASED ALLOYS

BACKGROUND OF THE INVENTION

The iron-based low alloyed carbon steels extensively used by mankind been known for more than one hundred years. Although their good mechanical properties has been considered to be a favorable factor, the low price has long been considered as the main reason favorable for extensive use. It is easily seen that the lower price of the carbon steels depends closely on the cost of raw materials, production processes and the production practices used. The advantages for carbon steels are the cheap final products, stable properties, good workability and as on, which result from the low cost of raw materials, mass production and the well-established technology, while the disadvantages for carbon steels are the lower corrosion resistance against atmosphere, the lower mechanical strength at high temperature, and their higher density. In order to improve the above disadvantages, one of the best solution was the utilization of Fe-Mn-Al-C alloy. According to the former inventation of the art (e.g. U.S.A. Pat. No.: 422,403, 1,892,316, 2,376,869, 3,111,405, 3,193,384, 3,201,230), the Fe-Mn-Al-C alloys have a good corrosion resistance, good mechanical properties at high temperature as well as at low temperature, and the lower density while this steel still possibly reserves the advantages of the carbon steels.

However, the former inventions of the art described just the methods for the experimental production rather than that of the mass production and at present the most commonly used melting methods are nearly the same method, i.e., the induction furnace is the only one use for melting these alloys. Further more, there is no continuous processing method for the consequential working of this Fe-Mn-Al-C alloy.

Owing to the above mentioned reasons, the production cost of this Fe-Mn-Al-C steel is still higher, therefore an object of this invention is to produce a substantially low cost method for producing the said Fe-Mn-Al-C alloy which comprises melting and the following working for the mass production of the said Fe-Mn-Al-C alloy.

BRIEF DESCRIPTION OF THE INVENTION

This invention is a method of producing the Fe-Mn-Al-C alloy products, which comprises the following processing:

1. Melting: The combination of the arc furnace or induction furnace, with the $O_2$, Ar, $N_2$, . . . , controlled atmosphere, is to be used as a melting practice.

2. Casting: Includes non-continuous and continuous casting, the casting sizes being various.

3. Hot-rolling: The hot-rolling temperature will be in the range of 850 C. to 1200 C. The steel ingots will be hot-rolled to the product of rods, plates and coils.

4. Hot forging: Includes free forging and swaging, the ingot of the Fe-Mn-Al alloy will be forged to the desired shape and size at the temperature of 800 C. to 1250 C.

5. Cold rolling: The hot-rolled coil will be cold-rolled to the desired thickness at room temperature.

6. Surface finishing: The objects of the surface finishing on the products of Fe-Mn-Al-C alloy enable a clean surface of the products by removing the scale and forming a protective layer in order to increase the corrosion resistance. This includes the shot peening process, mechanical grinding and polishing, peeling, scarfing, pickling, electroplating, electrocleaning, electrolytic polishing, high energy surface melting (e.g. laser melting process), anodizing and color development process.

7. Heat treating: The aim of the heat treatment for the Fe-Mn-Al-C alloy is to homogenize the product, and to relieve the mechanical and thermal stresses formed during the processing. The homogenization, annealing and tempering are included.

The said composition of the said Fe-Mn-Al-C alloy in this invention comprises principally by weight 10 to 45% Mn, 4 to 15 Al, 0.01 to 1.4 C, a small amount of Si, Cu, Mo, Nb, V, Co, Ti, B, N, Y, Zr, Hf, Ta, Sc, W, and the balance essentially Fe. The said product of the said Fe-Mn-Al-C alloy in this invention comprises ingots, slabs, billets, blooms, castings, forgings, hot-rolled plate, hot-rolled coil, bar, rod, and cold-rolled sheet and strip.

DETAILS OF THE INVENTION

This invention relates to the mass production of the said Fe-Mn-Al-C alloy and the products thereof using the conventional carbon steel processing techniques. A principal object of the present invention is to provide cheap products with a low density, a good corrosion and oxidation resistance up to high temperature, good damping capacity and good ductility at sub-zero temperatures.

Other objects of the invention will in part be obvious and will in part appear hereinafter. While this specification concludes with claims particularly pointing out and distinctly claiming that which is considered to be the invention. It is believed that the invention can be better understood from a reading of the following detailed description of the invention and the appended examples.

The processing techniques will list as follow:

1. Melting:

A. The low S and P high carbon ferromanganese, medium carbon ferromanganese, or low carbon ferromanganese will be remelted in an arc furnace. With the oxygen blowing the carbon will be oxidized and removed by controlling the blowing time, thereafter the scrap will be added for remelting. Then a small amount of Cr, Mo, Nb, Cu, Ni, etc. will be added, if necessary, to adjust the composition. The heat analysis will be analyzed by an X-ray fluorescence to have a strict control of Mn, C, S, P and other alloying elements.

B. The remelting of Al may be operated in a reverberatory furnace or an induction furnace. After remelting the liquid Al will be evenly poured into the induction furnace. (If Al is remelted in the induction furnaces originally, then this step will be omitted.)

C. The liquid Mn-Fe (in Step A) will be evenly poured into the induction furnace where liquid Al is ready for mixing with the liquid Mn-Fe by gaseous Ar or $N_2$ stirrer to obtain a homogeneous composition.

D. The homogenized liquid Fe-Mn-Al-C alloy will then be poured into a ladle where the liquid will be kept until at 1530–1580 C. With the top/bottom/side blowing of $N_2$, the liquid steel will further be mixed and this step can let $N_2$ dissolve into the liquid steel. The $N_2$ blowing time will be 10 sec. to 5 min. Meanwhile, the Ar can mixed with $N_2$ to improve the stirring if necessary. After the blowing, holding time of 1 to several minutes will be necessary. In order to have a good quality of the cast, the casting temperature of the liquid steel will be controlled at 1350–1550 C.

2. Casting:

Casting can be divided into non-continuous casting and continuous casting. The former consists of casting single heats with a time interval and consequent breaks in production. For example, liquid steel flows from ladle, through pouring gate and runner, to one or tens of sand-molds, metal-molds, or ceramic-molds. After finishing a set of mold cast, another set will continue. If continuous casting will be adopted, liquid steel flows from ladle through tundish to the continuous casting mould. The cooled metal then passes through vertical cooling chamber, curved cooling chamber, or horizontal cooling chamber. The cast steel is drawn with withdrawal rolls, straightened, and cut with plasma or cutter to get the ingot, billet, bloom, and slab of a desired size and shape.

3. Descaling:

Ingot, billet, bloom, slab and cast piece are descaled by grinding, chemical etching, electrocleaning, chemical pickling and so on.

4. Hot rolling:

Ingot, billet, bloom, and slab will be homogenized in a reheating furnace at 950 to 1150 C. for 3 to 20 hrs, then heated to 1200 C. for 10–30 min. Before rolling the ingot, billet, bloom and slab can be descaled by the scale breaker (e.g. high pressure water). By the various pass designs products of different size, shape and thickness can be obtained. The starting temperature of the hot rolling for Fe-Mn-Al-C alloy is in the range of 1100 C.–1200 C., while the finishing temperature is in the range of 800 C.–1050 C. In order to have a solid sealing at the shrinkage cavity of the non-continuous casting ingot, billet, bloom and slab, the reduction rate of the first pass is set at 20%–25%.

5. Hot forging:

Hot-rolled products (e.g. round bar, square bar) and cast piece can be reheated in a furnace at a temperature of 1100–1200 C. for 10–30 min, and then swaged or free forged into the desired size and shape. The optimum forging temperature is in the range of 800 C.–1250 C.

6. Cold rolling:

Fe-Mn-Al-C alloy hot-rolled sheet coils can be annealed in an Ar protected atmosphere reheating furnace at 950–1150 C. for 5–40 min. After annealing, the coils are descaled by a combination or any process of the following methods such as shot pinning and chemical etching, electroplating, electropickling, chemical pickling and electrogrinding. Then the coils will enter trains of cold rolling stands to the desired thicknesses of cold rolled sheets and strips.

7. Surface finishing:

Fe-Mn-Al-C alloy cold-rolled sheets and strips may enter continuous annealing line or batch-type annealing furnace with Ar atmosphere protected at 950–1150 C. for 5–30 min again. The annealed sheets and strips may be descaled by shot peening followed by mechanical polishing, pickling, electrogrinding, electropolishing, anodizing, or high-energy-surface-melting treatment and the combination thereof. Other surface finishing practices comprise the formation of the passive protection film or the use of high energy evaporation of Mn on the surface, which has the effects of removing MnS and increasing the amount of Cr and Al resulting in a more effective corrosion resistance. After the passive film or high-energy-surface-evaporation treatment, color-development may be used to form a colored film. Finally, a 0.1–0.9% reduction of last pass, temper rolling, is performed to have a flatten and luster surface for the Fe-Mn-Al-C alloy strips and sheets.

The following examples are offered to aid in understanding of the present invention and are not to be construed as limiting the scope thereof. Unless otherwise indicated, all parts and percentages are by weight.

EXAMPLE I

This example verifies the method of melting process enclosed in the present invention.

A mixture of one ton high carbon ferromanganese and scrap was charged into a 1.5 ton arc furnace. The compositions of the high carbon ferromanganese and scrap are listed in Table I, the weight of each is also listed in Table I. When the mixture was molten, the mixing gas of oxygen and argon were blown into the arc furnace to burn out the excess carbon content. The blowing of argon was to stir the molten steel homogeneously. Meanwhile, the slag-controller ($CaC2+CaF2+CaO+CaCl2$) was added to dephosphorus. This step continued for 15 minutes, the temperature was kept at 1450 C. After the deslagging process, the temperature of the arc furnace rose to 1580 C. At the same time, an arc furnace of 1.5 ton capacity was charged with 100 kilogram pure aluminum. When the aluminum was remelted, the molten steel of the arc furnace was charged into the induction furnace. The power of the induction furnace was increased to make sure that the mixing was very homogeneous. After 5 minutes, the mixed liquid steel then charged into a ladle at 1579 C. Nitrogen was blown from the bottom of the ladle to the liquid for 1.5 minutes. Then the ladle held for 5 minutes to tapping until temperature at 1490 C. The chemical composition of the casted piece was analyzed and listed in Table II.

TABLE I

| Designation | Composition (%) | | | | | | Total amount (Kg) |
|---|---|---|---|---|---|---|---|
| | Mn | Fe | C | Si | P | S | |
| high C ferromanganese | 73 | 20 | 7 | 0.2 | 0.06 | 0.05 | 410 |
| scrap | 0.38 | 99.5 | 0.1 | 0.1 | 0.017 | 0.035 | 590 |

TABLE II

| Composition | | | | | | |
|---|---|---|---|---|---|---|
| Mn | Al | C | Si | S | P | N |
| 24.7 | 8.9 | 1.1 | 0.15 | 0.04 | 0.03 | 0.01 |

EXAMPLE II

This example verifies the corrosion resistance of the Fe-Mn-Al-C based alloy improved greatly by pickling treatment. The chemical compositions of the pickling solutions are listed in Table III. The compositions of experimental alloys A, B and C are listed in Table IV. These alloys were hot forged, and cold rolled into a 2 mm thick sheet. These samples were immersed in the pickling solution for 1 minute, and then immersed into the 3.5 wt% NaCl aqueous solution for 1 month. The corrosion rates of the samples with pickling and without pickling were listed in Table V. It is obvious that the corrosion resistance of the pickled samples increased tremendously.

TABLE III

| No. | Pickling solution concentration (vol %) |
|---|---|
| 1 | 5% $HNO_3$ + 0.2 HF |
| 2 | 10% $HN0_3$ + 0.2 HF |
| 3 | 7% $H_3PO_4$ + 25 g/l $H_2CrO_4$ |

TABLE IV

| No. | Alloy composition Mn | Al | C | Cr | N |
|---|---|---|---|---|---|
| A | 24.2 | 7.5 | 0.76 | 3.2 | 0.005 |
| B | 30.4 | 6.9 | 0.84 | 5.6 | — |
| C | 27.3 | 10.5 | 0.98 | — | — |

TABLE V

| solution No. / alloy No. | Corrosion rate 1 | 2 | 3 | without picking |
|---|---|---|---|---|
| A | 0.018 | 0.020 | 0.07 | 0.098 |
| B | 0.010 | 0.015 | 0.05 | 0.074 |
| C | 0.150 | 0.140 | 0.12 | 0.160 |

EXAMPLE III

This example verifies the corrosion resistance of the Fe-Mn-Al-C based alloys enhanced greatly by the electropolishing treatment of the present invention. The composition and the preparation of the experimental samples are the same to Example II. The chemical composition of the electropolishing solution are listed in Table VI. The experimental condition for the electropolishing were: 20 C., 5 minutes and 1.4 A/cm$^2$. These electropolished samples were also immersed in the 3.5 wt% NaCl aqueous solution. From the corrosion rate of these samples listed in Table VII, it is very clear that the electropolishing greatly influences the corrosion resistance of the Fe-Mn-Al-C based alloys.

TABLE VI

| No. | Concentration |
|---|---|
| 1 | 80% $HClO_4$ + 20% $CH_3COOH$ |
| 2 | 10% $CrO_3$ + 70% $H_3PO_4$ + 20% $H2SO_4$ |

TABLE VII

| Solution No. / alloy No. | Corrosion rates 1 | 2 | without electropolishing |
|---|---|---|---|
| A | 0.022 | 0.068 | 0.098 |
| B | 0.015 | 0.014 | 0.074 |

TABLE VII-continued

| Solution No. / alloy No. | Corrosion rates 1 | 2 | without electropolishing |
|---|---|---|---|
| C | 0.130 | 0.119 | 0.160 |

I claim:

1. The melting method for producing a (of the said) Fe-Mn-Al-C alloy which comprises melting ferromanganese and steel scrap in an arc furnace, adjusting the carbon content of the resulting melt to be not more than about 1.4% by oxygen blowing, melting aluminum in a separate furnace, mixing the molten metals in a furnace and then pouring molten metal mixture into a ladle for further mixing by blowing with a non-oxidizing gas to obtain a homogeneous composition, and tapping the resulting Fe-Mn-Al-C melt.

2. The melting method of claim 1 wherein said Fe-Mn-Al-C alloy consists essentially of, by weight, 10 to 45 percent manganese, 4 to 15 percent Aluminum, 0 to 12 percent chromium, 0 to 2.5 percent silicon. 0.01 to 1.4 percent carbon and the balance essentially iron.

3. The melting method of claim 2 wherein said melt consists essentially of, by weight, 15 to 45 percent manganese, and 0.1 to 3.5 percent, by weight, total of at least one element from the group consisting of Mo, Nb, Ti, V and W.

4. The melting method of claim 2 wherein said melt consists of, by weight, at least one element from the group consisting of 0.1 to 3.5 percent copper and 0.1 to 7.5 percent nickel.

5. The melting method of claim 2 wherein said melt consists essentially of, by weight, 0.01 to 1.0 percent total of at least one element from the group consisting of Y, Sc, Ta and Hf.

6. The melting method of claim 2 wherein said melt consists essentially of, by weight, 50–200 ppm boron.

7. The melting method of claim 3 (2) wherein said melt consists essentially of, by weight, 0.002 to 0.2 percent nitrogen.

8. The melting method of claim 1 wherein said non-oxidizing gas is selected from the group consisting of nitrogen and argon.

9. The melting method of claim 1 wherein said molten metals are at a temperature of about 1530 to 1580 degrees C.

10. The melting method of claim 1 wherein tapping said melt is at a temperature of about 1550 to 1350 degrees C.

11. The melting method of claim 1 wherein mixing said molten metals are in an induction furnace followed by pouring into a ladle, blowing with an argon-nitrogen mixture for 5 seconds to 5 minutes and held after blowing for one to twenty minutes followed by tapping.

12. The melting method of claim 1 wherein melting said aluminum is in an induction or a reverberatory furnace.

* * * * *